US008240151B2

(12) United States Patent
Pelletier et al.

(10) Patent No.: US 8,240,151 B2
(45) Date of Patent: Aug. 14, 2012

(54) FUEL INJECTOR NOZZLES FOR GAS TURBINE ENGINES

(75) Inventors: Robert R. Pelletier, Chardon, OH (US); Ravi Gudiapti, Willoughby, OH (US); Kenneth W. Cornett, Ivoryton, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 1431 days.

(21) Appl. No.: 11/625,539

(22) Filed: Jan. 22, 2007

(65) Prior Publication Data

US 2010/0251720 A1 Oct. 7, 2010

Related U.S. Application Data

(60) Provisional application No. 60/761,023, filed on Jan. 20, 2006.

(51) Int. Cl.
*F02C 1/00* (2006.01)

(52) U.S. Cl. ..... 60/740; 60/742; 60/748

(58) Field of Classification Search ..... 60/740, 60/741, 748, 742, 746, 747, 799, 800
See application file for complete search history.

(56) References Cited

U.S. PATENT DOCUMENTS

| | | | | |
|---|---|---|---|---|
| 2,548,886 | A | 4/1951 | Howard | |
| 2,748,567 | A | 6/1956 | Dougherty | |
| 3,068,026 | A | 12/1962 | McKamey | |
| 4,258,544 | A | 3/1981 | Gebhart et al. | |
| 4,384,846 | A | 5/1983 | Waldhofer | |
| 4,409,791 | A | 10/1983 | Jourdain et al. | |
| 5,242,117 | A | 9/1993 | D'Agostino et al. | |
| 5,269,468 | A * | 12/1993 | Adiutori | 239/397.5 |
| 5,307,635 | A | 5/1994 | Graves et al. | |
| 5,361,578 | A | 11/1994 | Donlan | |
| 5,423,178 | A * | 6/1995 | Mains | 60/776 |
| 5,685,139 | A | 11/1997 | Mick et al. | |
| 6,076,356 | A | 6/2000 | Pelletier | |
| 6,182,437 | B1 * | 2/2001 | Prociw | 60/776 |
| 6,276,141 | B1 | 8/2001 | Pelletier | |
| 6,351,948 | B1 * | 3/2002 | Goeddeke | 60/740 |
| 6,622,488 | B2 | 9/2003 | Mansour et al. | |
| 7,658,074 | B2 * | 2/2010 | Tuttle | 60/737 |

* cited by examiner

*Primary Examiner* — Ehud Gartenberg
*Assistant Examiner* — Vikansha Dwivedi
(74) *Attorney, Agent, or Firm* — Renner, Otto, Boisselle & Sklar, LLP

(57) ABSTRACT

A fuel injector for a gas turbine engine comprises a housing stem and a nozzle, the nozzle including an internal wall in heat transfer relation with fuel flowing through the nozzle, and an external wall in heat transfer relation with ambient air. The internal and external walls have downstream tip ends that are relatively moveable at an interface due to relative thermal growth during operation of the engine. An internal insulating gap is disposed between the internal and external walls to provide a heat shield for the internal wall, and a bellows internal to the injector has an upstream end sealingly attached to an upstream portion of one of the internal and external walls, and a downstream end sealingly attached to a downstream portion of the other wall to fluidly separate the insulating gap from any fuel entering into the nozzle through the interface.

25 Claims, 6 Drawing Sheets

FUEL INJECTOR NOZZLES FOR GAS TURBINE ENGINES

RELATED CASES

This application claims the benefit of the filing date of U.S. Provisional Application No. 60/761,023 filed Jan. 20, 2006, which is hereby incorporated herein by reference.

FIELD OF THE INVENTION

The present invention relates generally to injectors and nozzles for high temperature applications, and more particularly to fuel injectors and nozzles for gas turbine engines of aircraft.

BACKGROUND

Fuel injectors for gas turbine engines on an aircraft direct fuel from a manifold to a combustion chamber of a combustor. The fuel injector typically has an inlet fitting connected to the manifold for receiving the fuel, a fuel nozzle located within the combustor for spraying fuel into the combustion chamber, and a housing stem extending between and fluidly interconnecting the inlet fitting and the fuel nozzle. The housing stem typically has a mounting flange for attachment to the casing of the combustor.

Fuel injectors are usually heat-shielded because of a high operating temperatures arising from high temperature gas turbine compressor discharge air flowing around the housing stem and nozzle. The heat shielding prevents the fuel passing through the injector from breaking down into its constituent components (i.e., "coking"), which may occur when the wetted wall temperatures of a fuel passage exceed 400° F. The coke in the fuel passages of the fuel injector can build up to restrict fuel flow to the nozzle.

Heretofore, injector nozzles have included annular stagnant air gaps as insulation between external walls, such as those in thermal contact with high temperature ambient conditions, and internal walls in thermal contact with the fuel. In order to accommodate differential expansion of the internal and external walls while minimizing thermally induced stresses, the walls heretofore have been anchored at one end and free at the other end for relative movement. If the downstream tip ends of the walls are the ends left free for relative movement, even a close fitting sliding interface between the downstream tip ends can allow fuel to pass into the air gap formed between the walls. This can result in carbon being formed in the air gap, which carbon is not as good an insulator as air. In addition, the carbon may build up to a point where it blocks venting of the air gap to the air gap in the stem, which can lead to an accumulation of fuel in the air gap. This can lead to diminished nozzle service life.

SUMMARY OF THE INVENTION

The present invention provides, inter alia, a novel and unique fuel injector for a gas turbine engine of an aircraft, and more particularly a novel and unique heatshield structure for a fuel nozzle. In accordance with the invention, a bellows is uniquely assembled in the nozzle to isolate a portion of an insulating gap from an interface whereat fuel may enter the insulating gap. Although the invention is particularly applicable to fuel injectors and nozzles for gas turbine engines, principles of the invention also are more generally applicable to other applications, particularly high temperature applications where insulating gaps are provided in the nozzle and into which an ambient fluid may enter through an interface between relatively moving parts of the nozzle.

Accordingly, a nozzle comprises an inlet at an upstream end of the nozzle, a discharge outlet at a downstream end of the nozzle, and a fluid delivery passage extending between the inlet and the discharge outlet. An internal annular wall bounds one side of the fluid delivery passage along a length thereof, whereby such wall is in heat transfer relation with fluid passing through the fluid delivery passage. An exterior annular wall is interposed between the internal annular wall and ambient conditions surrounding the nozzle, and the exterior and interior walls have downstream tip ends that are relatively longitudinally movable at an interface, as may arise from relative thermal growth during use of the nozzle under high temperature conditions. Additionally, an internal insulating gap is interposed between the interior and exterior walls to insulate the internal wall from ambient temperature conditions exterior to the nozzle, and an annular bellows internal to the injector has an upstream end sealingly attached to an upstream portion of one of the internal and external walls, and a downstream end sealingly attached to a downstream portion of the other wall to fluidly separate a thereby isolated portion of the insulating gap from any ambient fluid entering into the insulating gap through the interface.

The nozzle may be further characterized by one or more of the following features:

a. the gap may be divided into radially inner and outer portions along a length of the bellows extending between its upstream and downstream ends;

b. the ends of the bellows may be sealingly attached to the internal and external walls by brazing;

c. the fluid delivery passage may include at least one vane configured to impart swirling to the fluid flowing to the discharge outlet;

d. the annular bellows may have circumferential convolutions;

e. the insulating gap may surround the internal wall and the external wall may surround the insulating gap;

f. the internal wall may surround the insulating gap, and the insulating gap may surround a central duct extending axially through the nozzle;

g. the central duct may include swirl vanes for imparting a rotary motion to an ambient fluid flowing through the central duct;

h. the insulating gap may contain air, another gas or an insulating material, or may be evacuated; and/or i. the insulating gap may extend substantially the entire length of the fluid delivery passage.

According to another aspect of the invention, a fuel injector for a gas turbine engine comprises a nozzle as above described for spraying fuel into a combustion chamber, and a housing stem for supporting the nozzle in the combustion chamber. The housing stem includes an internal fuel conduit for supplying fuel to the fluid inlet of the nozzle.

The fuel injector may be further characterized by one or more of the following features:

a. the housing stem may include an external wall surrounding the fuel conduit, and an insulating gap between the external wall and fuel conduit, which insulating gap is in fluid communication with the insulating gap of the nozzle;

b. the insulating gap may contain air, another gas or an insulating material, or may be evacuated;

c. the housing stem may extend from a fuel line fitting to the nozzle for connecting the nozzle to the fitting;

d. the housing stem and nozzle may be rigidly and fixedly connected together as a single component that can be inserted into and located within an opening in a combustor casing; and/or e. the housing stem may include a flange extending outwardly away from the stem, the flange having an attachment device to allow the stem to be attached to the gas turbine engine.

According to a further aspect of the invention, a fuel injector for a gas turbine engine comprises a housing stem and a nozzle, the nozzle including an internal wall in heat transfer relation with fuel flowing through the nozzle, and an external wall in heat transfer relation with ambient air. The internal and external walls have downstream tip ends that are relatively moveable at an interface due to relative thermal growth during operation of the engine. An internal insulating gap is disposed between the internal and external walls to provide a heat shield for the internal wall, and a bellows internal to the injector has an upstream end sealingly attached to an upstream portion of one of the internal and external walls, and a downstream end sealingly attached to a downstream portion of the other wall to fluidly separate the insulating gap from any fuel entering into the nozzle through the interface.

Other features and advantages of the present invention will become further apparent upon reviewing the following detailed description and attached drawings.

DETAILED DESCRIPTION

As above indicated, the principles of the present invention have particular application to fuel injectors and nozzles for gas turbine engines and thus will be described below chiefly in this context. It will of course be appreciated, and also understood, that the principles of the invention may be useful in other applications including, in particular, other fuel nozzle applications and more generally applications where a fluid is injected by a nozzle especially under high temperature conditions.

Figure 1:
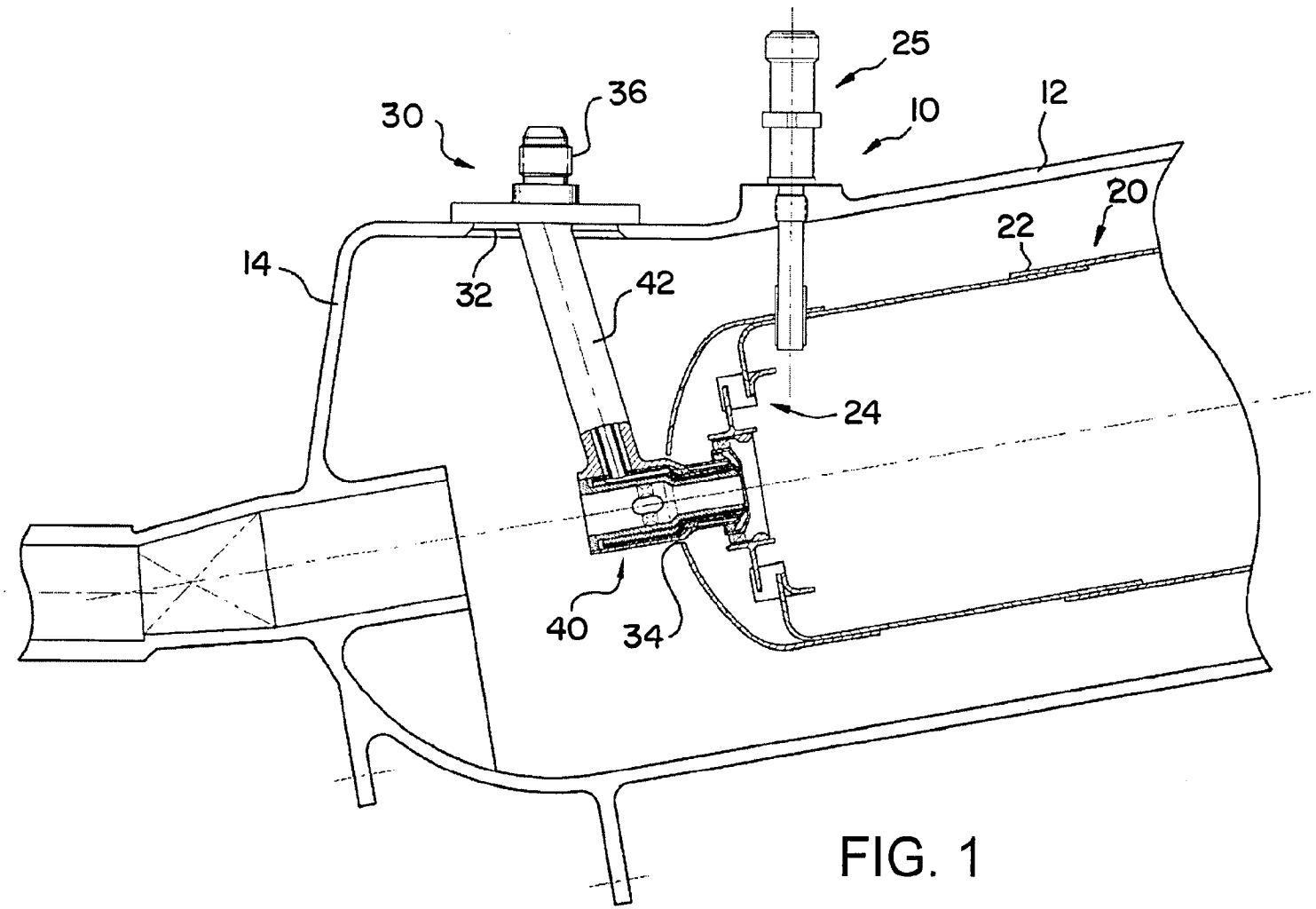
FIG. 1 is a partial cross-sectional view of a portion of a gas turbine engine illustrating a fuel injector constructed in accordance with the present invention.

Referring now in detail to the drawings and initially to FIG. 1, a gas turbine engine for an aircraft is illustrated generally at 10. The gas turbine engine 10 includes an outer casing 12 extending forwardly of an air diffuser 14. The casing and diffuser enclose a combustor, indicated generally at 20, for containment of burning fuel. The combustor 20 includes a liner 22 and a combustor dome, indicated generally at 24. An igniter, indicated generally at 25, is mounted to the casing 12 and extends inwardly into the combustor for igniting fuel. The above components can be conventional in the art and their manufacture and fabrication are well known.

A fuel injector, indicated generally at 30, is received within an aperture 32 formed in the engine casing 12 and extends inwardly through an aperture 34 in the combustor liner 22. The fuel injector 30 includes a fitting 36 exterior of the engine casing for receiving fuel, as by connection to a fuel manifold or line; a fuel nozzle, indicated generally at 40, disposed within the combustor for dispensing fuel; and a housing stem 42 interconnecting and structurally supporting the nozzle 40 with respect to fitting 36. The fuel injector is suitably secured to the engine casing, as by means of an annular flange 41 that may be formed in one piece with the housing stem 42 proximate the fitting 36. The flange extends radially outward from the housing stem and includes appropriate means, such as apertures, to allow the flange to be easily and securely connected to, and disconnected from, the casing of the engine using, as by bolts or rivets.

Figure 2:
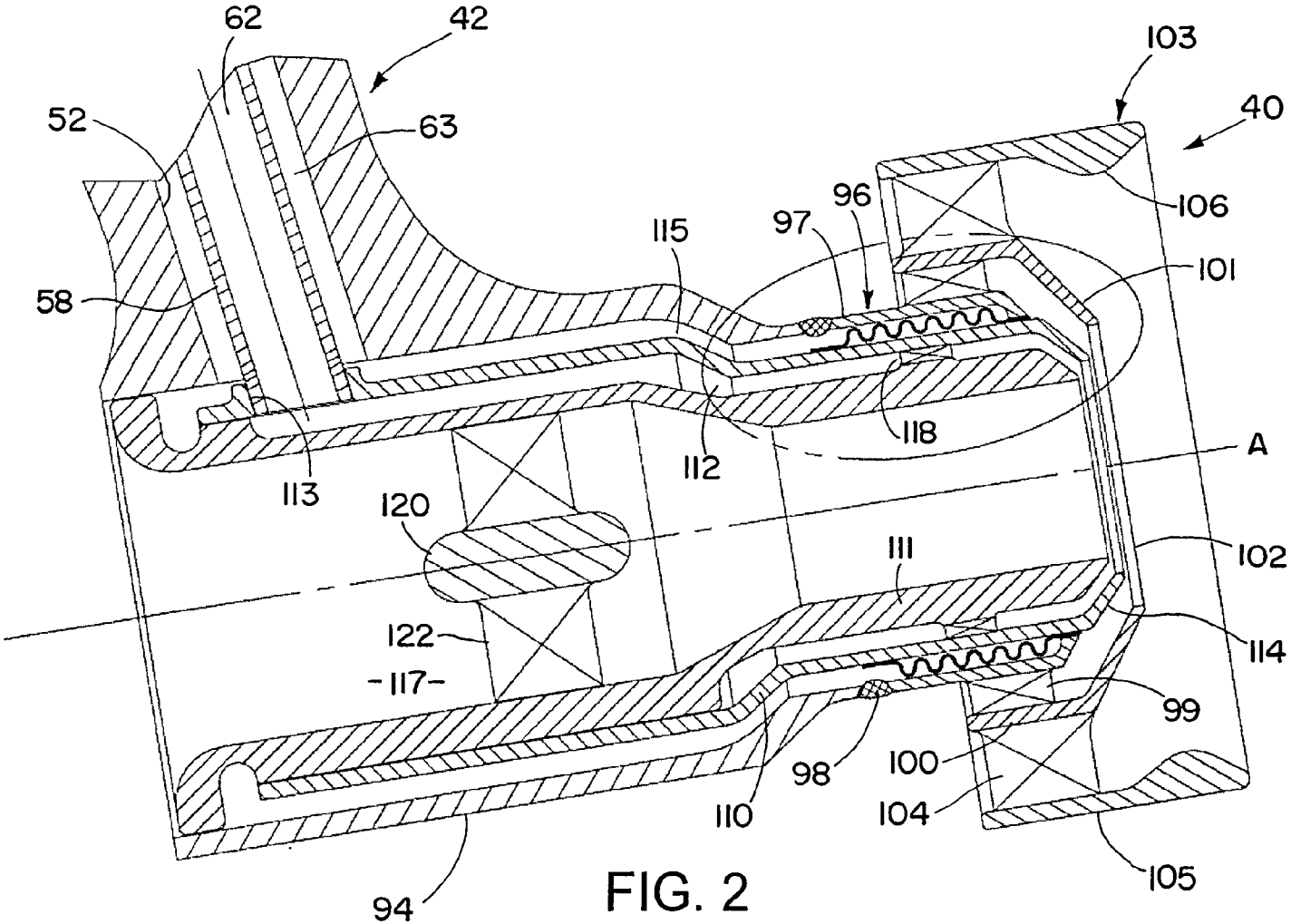
FIG. 2 is a fragmentary cross-sectional view of the fuel injector of FIG. 1, showing details of the injector nozzle.

As best seen in FIG. 2 when viewed in conjunction with FIG. 1, the housing stem 42 includes a central, longitudinally-extending bore 52 extending the length of the housing stem. A fuel conduit 58 extends through the bore and fluidly interconnects fitting 36 and nozzle 40. The fuel conduit 58 has an interior passage 62 for the passage of fuel. The fuel conduit 58 is surrounded by the bore 52 of the housing stem, and an annular insulating gap 63 is provided between the exterior surface of the fuel conduit 58 and the walls of the bore 52. The insulating gap 63 provides thermal protection for the fuel in the fuel conduit. The housing stem 42 has a thickness sufficient to support nozzle 40 in the combustor when the injector is mounted to the engine, and is formed of material appropriate for the particular application.

The housing stem 42 may be formed integrally with fuel nozzle 40, and preferably in one piece with at least a portion of the nozzle. The lower end of the housing stem includes an annular outer shroud 94 circumscribing the longitudinal axis "A" of the nozzle 40. The outer shroud 94 is connected at its downstream end to an annular outer air swirler 96, such as by welding at 98. The outer air swirler 96 includes an annular wall 97 forming a continuation of the shroud 94 and from which swirler vanes 99 may project radially outwardly to an annular shroud 100. The shroud 100 is tapered inwardly at its downstream end 101 to direct air in a swirling manner toward the central axis "A" at the discharge end 102 of the nozzle.

A second outer air swirler 103 may also be provided, in surrounding relation to the first air swirler 96. The second air swirler 103 also includes radially-outward projecting swirler vanes 104 and an annular shroud 105. The shroud 105 has a geometry at its downstream end 106 that also directs air in a swirling manner toward the central axis "A" at the discharge end 102 of the nozzle.

An annular prefilmer 110 and an annular fuel swirler 111 are disposed radially inwardly from the annular wall formed by the outer shroud 94 and air swirler 96. The prefilmer 110 closely surrounds the fuel swirler 111, and together the prefilmer and fuel swirler form internal walls of the nozzle that define therebetween a fuel passage 112, to direct fuel through the nozzle. The fuel swirler may be provided with vanes 118 that direct the fuel in a swirling manner as it flows past the vanes. The prefilmer 110 may have a fuel inlet opening 113 at its upstream end, that receives the downstream end of fuel conduit 58. The fuel conduit 58 may be fluidly sealed and rigidly and permanently attached within the opening in an appropriate manner, such as by welding or brazing. The prefilmer 110 may also be tapered inwardly at its downstream end 114 to direct fuel in a swirling manner toward the central axis "A" at the discharge end 102 of the nozzle. An air swirler 120 with radially-extending swirler blades 122 may also be provided in the air passage 117 bounded by the radially inner surface of the fuel swirler 111 as seen in FIG. 2. The air swirler 120 directs air in a swirling manner along the central axis "A" of the nozzle to the discharge end 102 of the nozzle.

Figure 3:
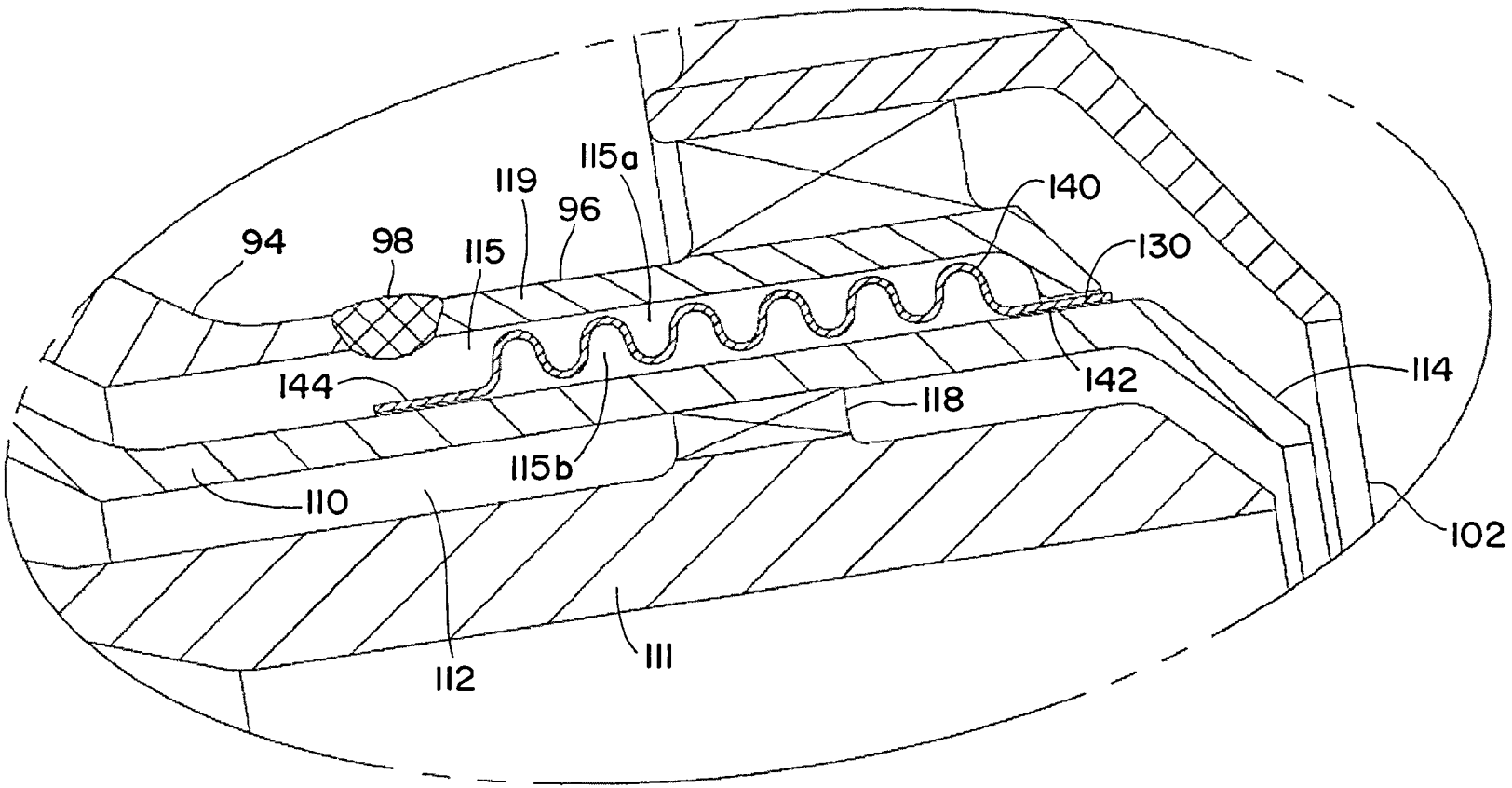
FIG. 3 is a fragmentary cross-sectional view of a portion of the injector nozzle, showing one configuration of an isolation bellows.

As best seen in FIG. 3, an annular insulating gap 115 is provided between the internal prefilmer 110 and the external shroud wall, indicated at 119, formed by the shroud 94 and the annular wall of the air swirler 96. The gap 115 may be in fluid communication with the insulating gap 63 in housing stem 42, as is desirable for venting any fuel that may accumulate in the insulating gap 115 to the insulating gap 63, which in turn may be vented, for example, to atmosphere. As with insulating gap 63, the insulating gap 115 provides thermal protection for internal components in thermal contact with the fuel in the nozzle.

In use, the shroud wall 119 will be in thermal contact with ambient conditions external to the nozzle, such being high temperature gas turbine compressor discharge air that passes around the nozzle. Consequently, the shroud wall will usually expand longitudinally (along the axis A) more than the prefilmer that is in thermal contact with the fuel. To avoid high stresses from being induced in the nozzle, the external shroud wall 119 and prefilmer 110 may have the upstream ends thereof anchored, i.e. fixed, with respect to one another, while the downstream tip ends thereof may be free to move relative to one another in the longitudinal direction, i.e. along the axis A of the nozzle.

To minimize the passage of fuel into the insulating gap 115, the tip ends of the shroud wall 119 and prefilmer 110 may be provided with a close fitting sliding interface indicated at 130. Notwithstanding the close fit, fuel may still pass into the insulating gap formed between the walls. This can result in carbon being formed in the insulating gap, which carbon is not as good an insulator as air. In addition, the carbon may build up to a point where it blocks venting of the insulation gap 115 to the insulation gap 63 in the stem, which can lead to an accumulation of fuel in the insulation gap. This may possibly lead to diminished nozzle service life.

In accordance with the present invention, an annular bellows 140 internal to the injector is provided in the insulating gap 115 to fluidly separate a thereby isolated portion 115*a* of the insulating gap 115 from any fuel that may enter into a non-isolated portion 115*b* of the gap 115 through the interface 130. The bellows 140 has an upstream end 144 sealingly attached to an upstream portion of one of the shroud wall 119 and prefilmer 110, and a downstream end 142 sealingly attached to a downstream portion of the other, thereby fluidly separating the then isolated portion 115*a* of the insulating gap from any fuel entering into the gap through the interface 130. In the embodiment illustrated in FIG. 3, the downstream end 142 of the bellows is sealingly attached to a downstream end of the shroud wall 119 by suitable means, such as brazing, and the upstream end 144 of the bellows is sealingly attached by suitable means, such as brazing, to the prefilmer 110 upstream of the connection between the bellows and the shroud. The bellows may be composed of any suitable material.

Figure 4:
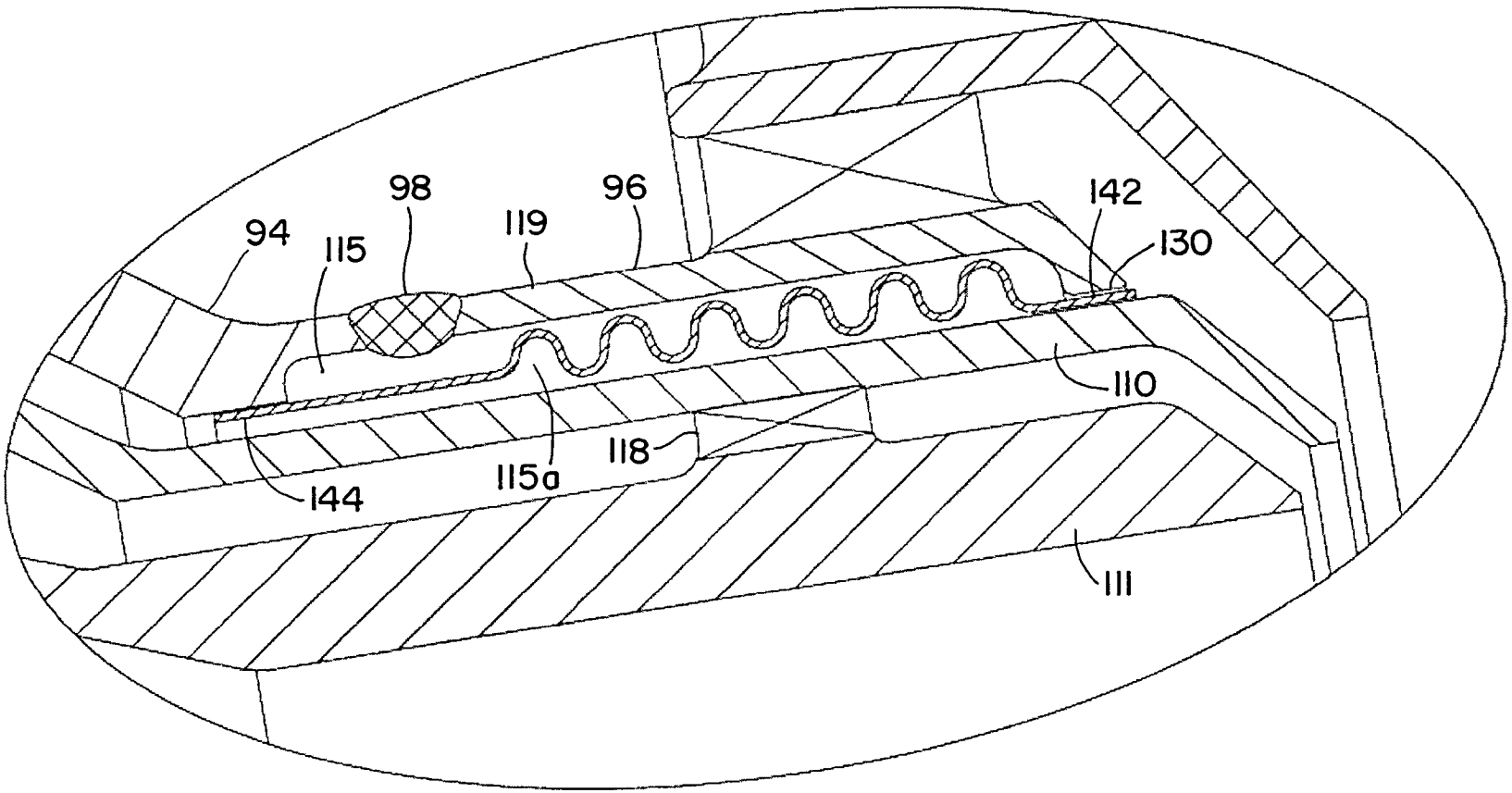
FIG. 4 is a fragmentary cross-sectional view similar to FIG. 3, but showing another configuration of an isolation bellows.

If desired, the connections may be made in the opposite manner as illustrated FIG. 4, wherein the same reference numerals are used to denote like components. In this version of the nozzle, which is otherwise identical to the nozzle shown in FIG. 3, the downstream end 142 of the bellows is sealingly attached to a downstream end of the prefilmer 110, and the upstream end 144 of the bellows is sealingly attached to the shroud wall 119 upstream of the connection between the bellows and the prefilmer.

Figure 5:
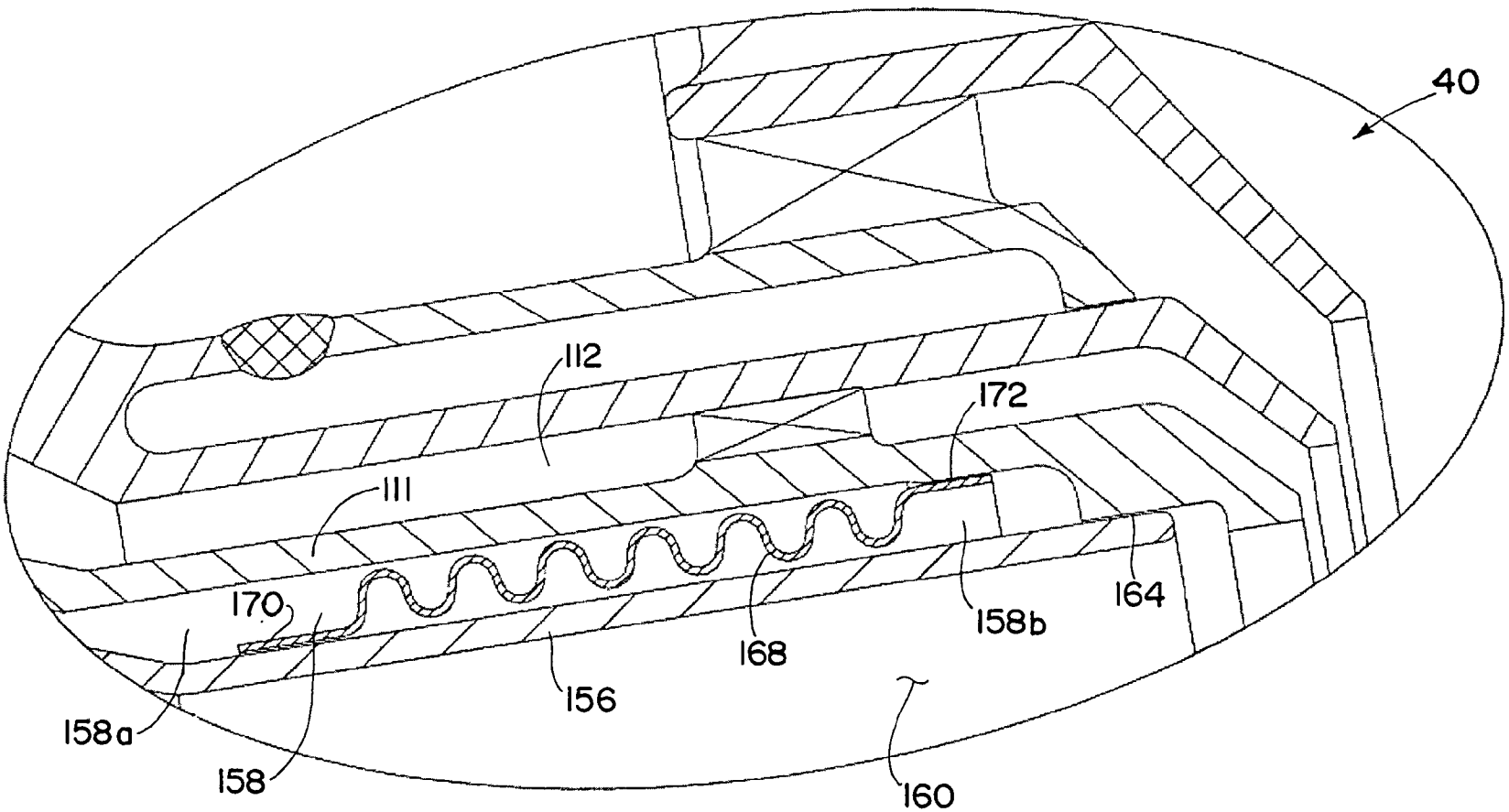
FIG. 5 is a fragmentary cross-sectional view of another embodiment of a nozzle according to the invention, where the bellows is located in an insulating gap surrounding an inner annular heat shield that defines a center duct through the nozzle.

Referring now to FIG. 5, wherein the reference numerals used above are used to denote like components, the nozzle 40 may be provided with an inner annular heat shield 156 disposed radially inward from the fuel swirler 111. The inner heat shield 156 may extend centrally within the nozzle. The inner heat shield and fuel swirler respectively form external and internal walls of the nozzle that have an insulating gap 158 therebetween that functions to protect the fuel from the elevated temperatures. The inner heat shield further defines a central air passage (duct) 160 extending axially through the nozzle, and the central air passage 160 may be provided with swirl vanes as in the manner shown in FIG. 2. The insulating gap 158 may be connected by a suitable passage in the nozzle to the insulating gap of the housing stem for venting, if desired.

In use, the inner heat shield 156 will be in thermal contact with ambient conditions external to the nozzle, such being high temperature high temperature gas turbine compressor discharge air that passes through the nozzle. Consequently, the inner heat shield will usually expand longitudinally (along the axis A) more than the fuel swirler 111 that is in thermal contact with the fuel. To avoid high stresses from being induced in the nozzle, the inner heat shield and fuel swirler may have the upstream ends thereof anchored, i.e. fixed, with respect to one another, while the downstream tip ends thereof may be free to move relative to one another in the longitudinal direction, i.e. along the axis A of the nozzle.

To minimize the passage of fuel into the insulating gaps, the tip ends of the tip ends of the fuel swirler 111 and inner heat shield 156 may be provided with a close fitting sliding interface indicated at 164. Notwithstanding the close fit, fuel may still pass into the insulating gap 158 formed between the walls. This can result in carbon being formed in the insulating gap, which carbon is not as good an insulator as air. In addition, the carbon may build up to a point where it blocks venting of the insulation gap 156 to the insulation gap 63 in the stem, if provided, and this can lead to an accumulation of fuel in the insulation gap. This may possibly lead to diminished nozzle service life.

In a manner similar to the bellows 140, an annular bellows 168 internal to the injector may be provided in the insulating gap 158 to fluidly separate a thereby isolated portion 158*a* of the insulating gap from any fuel that may enter into a non-isolated portion 158*b* of the gap 124 through the interface 164. The bellows may have an upstream end 170 sealingly attached to an upstream portion of one of the inner heat shield 156, and a downstream end 172 sealingly attached to a downstream or tip portion of the fuel swirler, thereby fluidly separating the then isolated portion 158*a* of the insulating gap from the non-isolated portion 158*b*. More particularly, the downstream end of the bellows may be sealingly attached by suitable means, such as brazing, to a downstream or tip end of the fuel swirler, and the upstream end of the bellows may be sealingly attached by suitable means to the inner heat shield.

Figure 6:
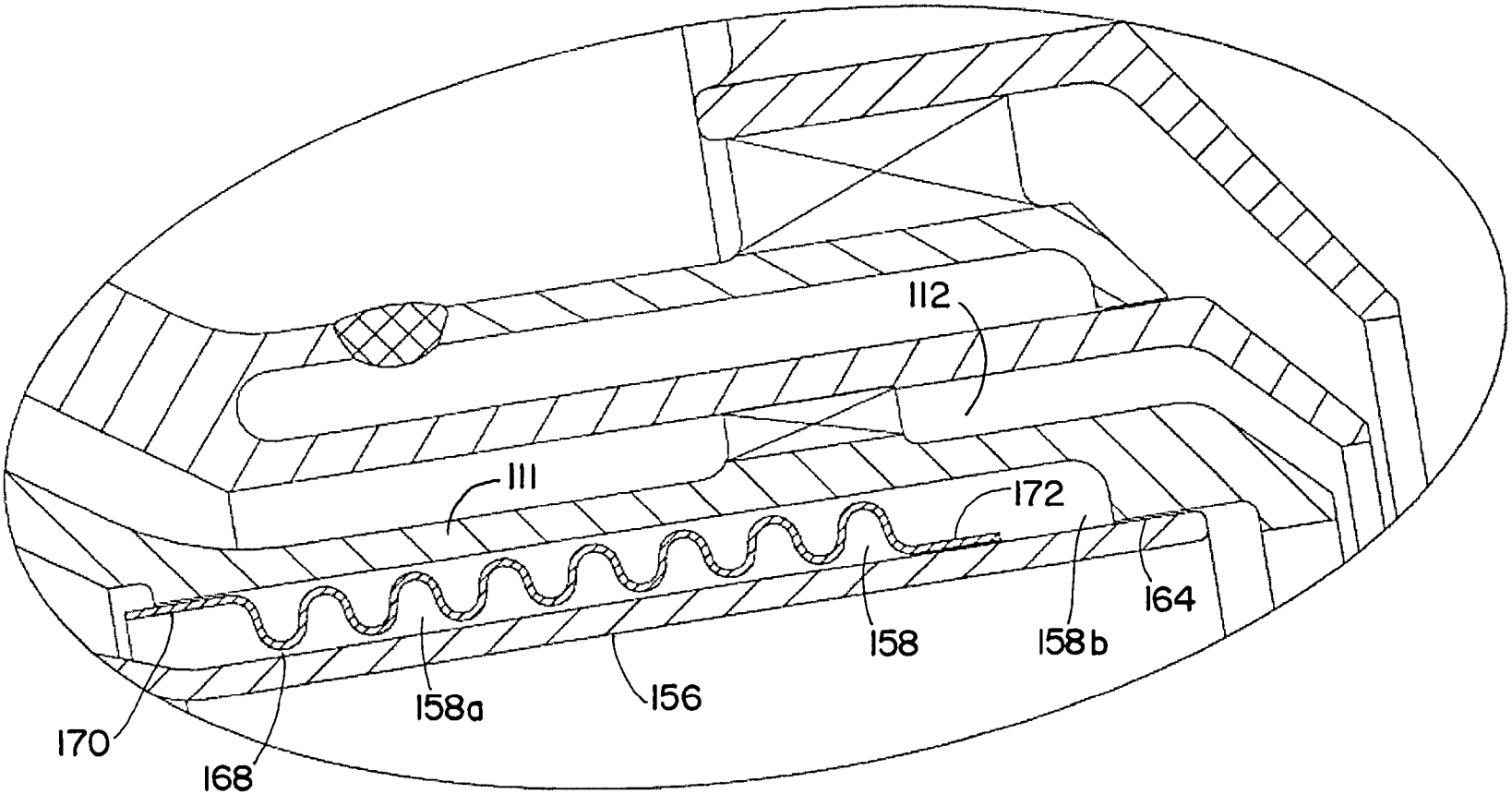
FIG. 6 is a fragmentary cross-sectional view similar to FIG. 5, but showing another configuration of an isolation bellows.

If desired, the connections may be made in the opposite manner as illustrated FIG. 6, wherein the same reference numerals are used to denote like components. In this version of the nozzle, which is otherwise identical to the nozzle shown in FIG. 5, the downstream end 172 of the bellows is sealingly attached to a downstream or tip end of the inner heat shield 156, and the upstream end 170 of the bellows is sealingly attached to the fuel swirler 111 upstream of the connection between the bellows and the inner heat shield.

In any of the various embodiments of a fuel nozzle according to the invention, the insulating gap 115, 158 may be divided into radially inner and outer portions along a length of the bellows 140, 168. The annular bellows may have circumferential convolutions as shown, and the peaks of the convolutions may be spaced from the relatively adjacent internal and external walls of the nozzle to minimize conduction of heat radially through the bellows.

In any of the various embodiments of a fuel nozzle according to the invention, the insulating gap may contain stagnant air, or another gas, or even an insulating material, or the gap may be evacuated.

The nozzle described above may be formed from an appropriate heat-resistant and corrosion resistant material, such as those known to those skilled in the art. The nozzle may be formed and assembled using conventional manufacturing techniques.

Any suitable means may be used to manufacture and assemble the nozzle. By way of example and in relation to the nozzle embodiment shown in FIGS. 2 and 3, the air swirler 120, fuel swirler 111 and prefilmer 110 may be pre-assembled such as by brazing, as may the air swirlers 96 and 103. In addition, the downstream end of the bellows may be brazed to the downstream or tip end of the air swirler 96, and the upstream end may be coated with solder on its radially inner side. The fuel conduit 58 may be sealed to the fitting 36, and the fuel conduit 58 may be inserted into bore 52 of housing stem 42, with the downstream end of fuel conduit 58 being received within the opening 113 in prefilmer 110 and brazed thereto. The air swirler 96 with the bellows attached thereto may be slipped over the prefilmer and welded to the outer shroud 94 of the housing stem. The nozzle can then be heated in a brazing chamber to braze the upstream end of the bellows to the prefilmer. The assembled fuel injector can then be inserted through the opening 32 in the engine casing (see FIG. 1), with the nozzle being received within the opening 34 in the combustor. The flange 90 on the fuel injector is then secured to the engine casing such as with bolts or rivets.

The skilled person will also appreciate that a nozzle may be provided with both a radially outer insulating gap 115 and a radially inner insulating gap 158, and either one or both may be provided with a bellows as shown in the several figures.

The skilled person will also appreciate that the bellows in the several embodiments may be sealingly attached to the walls of the nozzle by any suitable means, such as the above-described brazing, or even welding or by use of a high temperature adhesive. Other exemplary sealed attachment mechanisms include a metal-to-metal contact seal. For instance, the bellows ends may have a press-fit connection that will continue to effect a seal over the operating temperature range of the nozzle. It is noted that the bellows can be more resilient than the walls to which it is attached and thus accommodate differential radial expansion, as well as differential longitudinal expansion, to a greater extent. Moreover, the use of sealingly attached is not intended to necessarily mean a fixed or rigid non-moving connection. It is possible that a sealed connection can be effected between the bellows and adjacent wall while still allowing for relative movement, in particular relative longitudinal movement. If a telescopic union is provided and effectively sealed, the bellows itself need not necessarily be longitudinally expandable and contractible to accommodate the relative expansion of the walls to which its opposite ends are attached.

While several embodiments of a nozzle have been described above, it should be apparent to those skilled in the art that other nozzle (and stem) designs can be configured in accordance with the present invention. The invention is not limited to any particular nozzle design, but rather is appropriate for a wide variety of commercially-available nozzles, including nozzles for other applications where the nozzle is subjected to ambient high temperature conditions.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention.

What is claimed is:

1. A nozzle comprising:

an inlet at an upstream end of the nozzle;

a discharge outlet at a downstream end of the nozzle;

an first annular wall bounding one side of a fuel passage extending between the inlet and the discharge outlet along a length thereof, whereby such wall is in heat transfer relation with fluid passing through the fuel passage;

a second annular wall radially spaced from the first annular wall and interposed between the first annular wall and ambient conditions, the second and first walls having downstream tip ends that are relatively longitudinally movable at an interface;

an internal insulating gap interposed between the first and second walls to insulate the first wall from ambient temperature conditions exterior to the nozzle; and an annular bellows internal to the nozzle and located in the insulating gap, the bellows having an upstream end sealingly attached to an upstream portion of one of the first and second walls, and a downstream end sealingly attached to a downstream portion of the other of the first and second wall to fluidly separate a thereby isolated portion of the insulating gap from any ambient fluid entering into the gap through the interface.

2. A nozzle according to claim 1, wherein the insulating gap is divided into radially inner and outer portions along a length of the bellows extending between its upstream and downstream ends.

3. A nozzle according to claim 1, wherein the ends of the bellows are sealingly attached respectively to the first and second walls by brazing.

4. A nozzle according to claim 1, wherein the fuel passage includes at least one vane configured to impart swirling to the fuel flowing to the discharge outlet.

5. A nozzle according to claim 1, wherein the annular bellows has circumferential convolutions.

6. A nozzle according to claim 1, wherein the insulating gap surrounds the first wall and the second wall surrounds the insulating gap.

7. A nozzle according to claim 1, wherein the first wall surrounds the insulating gap, and the insulating gap surrounds a central duct extending axially through the nozzle.

8. A nozzle according to claim 1, wherein the central duct includes air swirl vanes for imparting a rotary motion to the air as the air flows through the central duct.

9. A nozzle according to claim 1, wherein the insulating gap extends substantially the entire length of the fuel passage.

10. A fuel injector for a gas turbine engine comprising a nozzle according to claim 1, and a housing stem for supporting the nozzle in a combustor chamber, the housing stem including an internal fuel conduit for supplying fuel to the inlet of the nozzle.

11. A fuel injector according to claim 10, wherein the housing stem includes an external wall surrounding the fuel conduit, and an insulating gap between the external wall and fuel conduit, which insulating gap is in fluid communication with the isolated portion of the insulating gap of the nozzle.

12. A fuel injector according to claim 10, wherein the insulating gap of the housing stem contains air.

13. A fuel injector according to claim 10, wherein the insulating gap of the housing stem is evacuated.

14. A fuel injector according to claim 10, wherein the housing stem extends from a fuel line fitting to the nozzle for connecting the nozzle to the fitting.

15. A fuel injector according to claim 10, wherein the housing stem and nozzle are rigidly and fixedly connected together as a single component that can be inserted into and located within an opening in the combustor casing.

16. A fuel injector according to claim 10, wherein the housing stem includes a flange extending outwardly away from the stem, the flange having an attachment device to allow the stem to be attached to the gas turbine engine.

17. A fuel injector for a gas turbine engine, comprising a housing stem and a nozzle, the nozzle including a first wall in heat transfer relation with fuel flowing through the nozzle, and a second wall radially spaced from the first annular wall and in heat transfer relation with ambient air, the first and second walls having downstream tip ends that are relatively moveable at an interface due to relative thermal growth during operation of the engine, an internal insulating gap disposed between the first and second walls to provide a heat shield for the first wall, and a bellows internal to the injector and located in the insulating gap, the bellows having an upstream end sealingly attached to an upstream portion of one of the first and second walls, and a downstream end sealingly attached to a downstream portion of the other wall to fluidly separate a thereby isolated portion of the insulating gap from any fuel entering into the nozzle through the interface.

18. A nozzle according to claim 1, wherein the insulating gap is in fluid communication with a second insulating gap in a housing stem to vent fluid in the insulating gap to the second insulating gap.

19. A nozzle according to claim 1, wherein the first wall is formed by a wall of a prefilmer and the second wall is formed by a wall of a shroud.

20. A fuel injector according to claim 17, wherein the first wall is formed by a wall of a prefilmer and the second wall is formed by a wall of a shroud.

21. A nozzle according to claim 1, further comprising an annular fuel swirler radially spaced from the first annular wall, the annular fuel swirler bounding a side of the fuel passage along a length thereof such that the first annular wall and the annular fuel swirler define the fuel passage.

22. A nozzle according to claim 1, wherein the downstream end of the bellows is sealingly attached to the downstream portion of one of the first and second annular walls at the tip end of the wall.

23. A nozzle according to claim 22, wherein the insulating gap is a stagnant gap formed along substantially the entire length of the nozzle.

24. A fuel injector according to claim 17, wherein the downstream end of the bellows is sealingly attached to the downstream portion of one of the first and second walls at the tip end of the wall.

25. A nozzle according to claim 24, wherein the insulating gap is a stagnant gap formed along substantially the entire length of the nozzle.

* * * * *